US012128992B1

(12) United States Patent
Farrell

(10) Patent No.: US 12,128,992 B1
(45) Date of Patent: Oct. 29, 2024

(54) CONVERTIBLE SEATING SYSTEM FOR MARINE VESSELS

(71) Applicant: Brunswick Corporation, Mettawa, IL (US)

(72) Inventor: Kevin T. Farrell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 414 days.

(21) Appl. No.: 17/482,937

(22) Filed: Sep. 23, 2021

Related U.S. Application Data

(60) Provisional application No. 63/119,877, filed on Dec. 1, 2020.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043; B60N 2/20; B60N 2/203; B60N 2/206; A47C 17/17; A47C 17/175; A47C 17/1753; A47C 17/1756
USPC ..... 114/363; 297/283.1, 283.2, 283.3, 297/353–383
See application file for complete search history.

(56) References Cited

U.S. PATENT DOCUMENTS 250,597 A 12/1881 St. John
427,413 A 5/1890 Fritz
831,877 A 9/1906 Kling
1,224,982 A * 5/1917 Washeim ..... A47C 1/026 5/55.1
1,271,830 A 7/1918 Austin
(Continued)

FOREIGN PATENT DOCUMENTS

CN 109693587 3/2021
DE 19501521 7/1995
(Continued)

OTHER PUBLICATIONS

Chris-Craft, Catalina 24. Retrieved from the web: https://www.chriscraft.com/models/catalina-series/catalina-24/ on Jan. 11, 2022.

*Primary Examiner* — Ajay Vasudeva
(74) *Attorney, Agent, or Firm* — Andrus Intellectual Property Law, LLP

(57) ABSTRACT

A convertible seating system for a marine vessel is provided. The system includes a stationary bracket coupled to a deck portion of the marine vessel, a forward-facing seat component and an aft-facing seat component. The forward-facing seat component includes a forward-facing base, a cushion component, and a pair of inner pivot brackets. The aft-facing seat component includes an aft-facing base, a cushion component, and a pair of outer pivot brackets. The inner and outer pivot brackets are pivotably coupled to the stationary bracket. A pair of inner spring pins extend through the pair of inner pivot brackets and into a first plurality of locating holes to lock the forward-facing seat component relative to the stationary bracket. A pair of outer spring pins extend through the pair of outer pivot brackets and into a second plurality of locating holes to lock the aft-facing seat component relative to the stationary bracket.

18 Claims, 9 Drawing Sheets

(56) References Cited

U.S. PATENT DOCUMENTS 1,782,231 A 11/1930 William et al.
1,792,737 A 2/1931 Greenstreet
2,076,309 A 4/1937 Whedon
2,113,346 A 4/1938 Heath
2,486,468 A 11/1949 Harry
2,900,009 A 8/1959 Haynes
2,969,107 A 1/1961 Naxon et al.
3,107,940 A 10/1963 Brooks et al.
3,379,471 A * 4/1968 Dalziel ..... A47C 17/16 297/63
3,482,870 A 12/1969 Janssen
3,506,303 A 4/1970 Smittle et al.
3,643,528 A 2/1972 Van Der Loos
3,743,350 A * 7/1973 Allen ..... A47C 17/1756 5/47
3,839,757 A 10/1974 Grimes
3,877,747 A 4/1975 Brennan et al.
3,884,522 A 5/1975 Arima et al.
4,030,436 A 6/1977 Stoberl
4,088,040 A 5/1978 Ross-Myring
4,099,768 A * 7/1978 Amos ..... A47C 1/026 297/63
4,536,027 A 8/1985 Brennan
4,558,901 A 12/1985 Yokoyama
4,567,845 A 2/1986 Smith
4,693,204 A * 9/1987 Klein ..... B63B 29/04 297/350
4,736,982 A 4/1988 Hwang
4,738,217 A 4/1988 Smith
4,775,187 A 10/1988 Herr
4,843,999 A 7/1989 Kobus et al.
4,854,261 A 8/1989 Goldsmith
4,926,783 A 5/1990 Lathers
5,052,076 A 10/1991 Spaeth
5,052,748 A 10/1991 Fourrey et al.
5,054,857 A 10/1991 Kvalheim
5,107,720 A 4/1992 Hatfield
5,136,963 A 8/1992 Zuzik
5,171,064 A 12/1992 Boussaroque
5,261,727 A 11/1993 Klaebel
5,313,033 A 5/1994 Link et al.
5,320,059 A 6/1994 Ikeda
5,329,871 A 7/1994 Gibbs
5,374,108 A 12/1994 Saul et al.
5,375,907 A 12/1994 Rogers et al.
5,381,585 A 1/1995 Olson et al.
5,531,506 A 7/1996 Scott
5,553,920 A 9/1996 Meschkat et al.
5,613,662 A 3/1997 Blackmore et al.
5,762,402 A 6/1998 Gillotti
5,782,534 A 7/1998 Desanta
5,799,605 A 9/1998 Huse
5,842,743 A 12/1998 Wright et al.
5,904,401 A 5/1999 Alberda et al.
5,913,571 A 6/1999 Dystra et al.
5,976,160 A 11/1999 Crainich
6,196,629 B1 3/2001 Onishi et al.
6,230,648 B1 5/2001 Davidson et al.
6,257,667 B1 7/2001 Boren et al.
6,283,059 B1 9/2001 Scully, Jr.
6,527,341 B1 3/2003 Martin
D481,986 S 11/2003 Menne
6,647,916 B2 11/2003 Neese et al.
6,766,759 B2 7/2004 Eck et al.
6,789,494 B2 9/2004 Neese et al.
6,866,022 B1 3/2005 Phillips et al.
6,880,482 B2 * 4/2005 Huse ..... B63B 29/04 297/65
6,883,458 B2 4/2005 Huse
6,918,160 B1 7/2005 Clark
6,940,026 B2 9/2005 Rundell et al.
6,945,190 B1 9/2005 Frandsen
7,000,557 B1 2/2006 Forbes et al.
7,107,927 B2 9/2006 Hopper et al.
7,121,218 B2 10/2006 Stinson et al.
7,156,442 B2 * 1/2007 McManus ..... B60N 2/933 296/65.09
7,172,252 B2 2/2007 Henning
7,255,058 B2 8/2007 Forbes et al.
7,302,906 B2 12/2007 Burroughs et al.
7,341,306 B1 3/2008 Neese et al.
7,367,616 B2 5/2008 Summerford
7,513,211 B1 4/2009 Farb et al.
7,647,880 B2 1/2010 Devine
7,661,382 B2 2/2010 Wood et al.
7,677,668 B2 3/2010 Olsen et al.
7,699,390 B2 4/2010 Baumann
7,819,483 B2 10/2010 Kushner et al.
7,828,383 B1 11/2010 Urbanek et al.
8,002,350 B2 8/2011 Johnson
8,028,641 B1 10/2011 Sly
8,109,563 B2 2/2012 Hansen
8,113,136 B2 2/2012 Mayrand et al.
8,113,137 B2 2/2012 Thompson
8,113,589 B2 2/2012 Mildt et al.
8,517,466 B1 4/2013 Wizorek et al.
8,499,377 B2 8/2013 Fafard et al.
8,720,990 B2 5/2014 Boydston
8,740,297 B1 6/2014 Foss et al.
8,801,099 B2 8/2014 Ebel et al.
8,840,175 B2 9/2014 Short
8,899,169 B1 12/2014 Jaziri
9,021,975 B1 5/2015 Fodor et al.
9,067,517 B1 6/2015 Roeglin et al.
9,073,608 B1 7/2015 Foss et al.
D743,318 S 11/2015 Curts
9,260,166 B1 2/2016 Fodor et al.
9,315,238 B2 4/2016 Neese et al.
9,370,245 B2 6/2016 Fafard et al.
9,403,597 B2 8/2016 Ferry et al.
9,440,560 B2 9/2016 Neese et al.
9,487,273 B1 11/2016 Eekhoff et al.
9,527,555 B2 12/2016 Ketterman et al.
9,650,117 B2 5/2017 Curts et al.
9,688,168 B2 6/2017 Gratz
9,701,368 B2 7/2017 Neese et al.
D794,537 S 8/2017 Wagnon
9,783,271 B2 10/2017 Foss et al.
9,821,887 B1 11/2017 Wilson et al.
9,907,404 B1 3/2018 Sorel et al.
9,919,625 B1 3/2018 Barbier et al.
D819,540 S 6/2018 Wilson et al.
10,005,380 B2 6/2018 Reid et al.
D824,836 S 8/2018 Deurr
10,065,711 B2 9/2018 Fuller, IV et al.
10,065,713 B2 9/2018 Murphy
D830,944 S 10/2018 Deurr
10,085,566 B1 10/2018 Gallant
10,149,544 B2 12/2018 Fafard et al.
10,150,539 B1 12/2018 Wilson et al.
10,207,776 B1 2/2019 Downey et al.
10,328,836 B2 6/2019 Purwin et al.
10,422,167 B2 9/2019 Huerta et al.
D864,081 S 10/2019 Barbier et al.
10,464,639 B2 11/2019 Neese et al.
10,471,859 B2 11/2019 Harrison, III et al.
10,479,233 B2 11/2019 Minato et al.
10,486,777 B1 11/2019 Barbier et al.
D870,016 S 12/2019 Wilson et al.
10,494,061 B2 12/2019 Fafard et al.
10,556,645 B1 * 2/2020 Levin ..... B63B 29/04
10,569,841 B2 2/2020 Fuller, IV et al.
10,759,502 B2 9/2020 Fafard et al.
10,933,774 B2 3/2021 Curts
11,034,414 B1 6/2021 Wilson et al.
11,174,893 B1 11/2021 Freer et al.
11,195,368 B2 12/2021 Patel et al.
11,286,022 B1 * 3/2022 Freer ..... B63B 29/04
2003/0197402 A1 10/2003 McCutcheon et al.
2003/0218369 A1 11/2003 Akaike et al.
2006/0103174 A1 5/2006 Queveau et al.
2007/0114819 A1 5/2007 Dougherty
2007/0158986 A1 7/2007 Adams et al.

(56) References Cited

U.S. PATENT DOCUMENTS

| | | | | |
|---|---|---|---|---|
| 2008/0066672 | A1* | 3/2008 | Eekhoff | B63B 29/04 297/344.1 |
| 2008/0196649 | A1 | 8/2008 | Kalil | |
| 2008/0236452 | A1 | 10/2008 | Pratt et al. | |
| 2009/0261629 | A1 | 10/2009 | Fafard et al. | |
| 2009/0277372 | A1 | 11/2009 | Wood et al. | |
| 2010/0018451 | A1 | 1/2010 | Sahr | |
| 2010/0037813 | A1 | 2/2010 | Sahr et al. | |
| 2010/0037814 | A1 | 2/2010 | Sahr et al. | |
| 2010/0201163 | A1 | 8/2010 | Dunkel | |
| 2011/0057483 | A1 | 3/2011 | Dickey et al. | |
| 2011/0109136 | A1 | 5/2011 | Fafard et al. | |
| 2011/0226900 | A1 | 9/2011 | Bamford et al. | |
| 2014/0216327 | A1 | 8/2014 | Chen | |
| 2014/0265500 | A1 | 9/2014 | Hough et al. | |
| 2016/0152169 | A1 | 6/2016 | Zheng et al. | |
| 2017/0233042 | A1 | 8/2017 | Curts et al. | |
| 2019/0104849 | A1 | 4/2019 | Fafard et al. | |
| 2020/0337467 | A1 | 10/2020 | Cannon | |
| 2020/0398944 | A1 | 12/2020 | Fafard et al. | |
| 2021/0169229 | A1 | 6/2021 | Niemela et al. | |
| 2021/0214052 | A1 | 7/2021 | Mast | |
| 2021/0298483 | A1 | 9/2021 | Donat | |
| 2022/0258835 | A1* | 8/2022 | Curts | B63B 32/70 |

FOREIGN PATENT DOCUMENTS

| | | |
|---|---|---|
| DE | 60207263 | 7/2006 |
| DE | 102011086751 | 5/2013 |
| GB | 635957 | 4/1950 |
| WO | 2019222749 | 11/2019 |

* cited by examiner

CONVERTIBLE SEATING SYSTEM FOR MARINE VESSELS

CROSS-REFERENCE TO RELATED APPLICATION

The present application claims the benefit of and priority to U.S. Provisional Application Ser. No. 63/119,877, filed Dec. 1, 2020, which application is hereby incorporated by reference in its entirety.

FIELD

The present disclosure relates to marine vessels and watercraft, and more particularly, pertains to a convertible seating system for marine vessels and watercraft that is pivotable between a forward-facing configuration, a sunpad configuration, and an aft-facing configuration.

BACKGROUND

U.S. Pat. No. 5,799,605 discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

U.S. Pat. No. 7,513,211 discloses a seat assembly for use in boats. The seat assembly includes a pair of seating platforms with a reclining seat back and a sliding seat bottom. A removable section is inserted between the seat bottom and the seat back to create a long recliner. A central panel and pad are set between the seating platforms to create a large surface area sunpad. The seating platforms are hollow to allow for storage of the central panels and pads and the removable sections.

U.S. Pat. No. 8,517,466 discloses a convertible boat seat that transforms from a standard bench-style seat configuration capable of accommodating multiple occupants to a lounger that allows a single occupant to comfortably lounge without impeding into the available deck space. A convertible boat seat comprises a chaise lounge type seat having a plurality of configurable components including a two-piece back rest, a configurable armrest, a hinging bench seat assembly, and an inclined chaise end forming a lounge backrest adapted with a pivoting armrest. The two-piece backrest includes first and second backrest components that are each configurable between a raised position and a lowered position. The inclined chaise end includes a pivoting armrest configurable between a stowed, out-of-the-way position, and a deployed position wherein it functions as a lounge armrest. A hinging bench seat includes first and second hingedly connected seat components that are configurable between a generally flat configuration for bench seating and a raised configuration wherein the lounger's knees are supported in a partially bent lounging position. On an opposing end of the inclined chaise end is an armrest configurable between a raised position wherein it functions as an armrest when the seat is configured for bench-style seating, and a lowered position wherein it is stowed generally flush with the bench seat surface for providing increased leg room while lounging.

U.S. Pat. No. 8,899,169 discloses a platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration. Both the seating recess and seat back panel can removably receive cushions for added comfort and support of the user. The configuration maximizes usable platform space when the seat back panels are closed.

U.S. Pat. No. 9,021,975 discloses a seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom.

U.S. Pat. No. 9,073,608 discloses a seating system for watercraft having a base supporting a seating surface and a backrest pivotably attached to the base. The backrest pivots about the seating surface to provide a plurality of selectable seating positions. The backrest is pivotably attached to the base by an arm attached to the side of the backrest. The arm engages a guide member attached to the base, the guide member having one or more positional slots corresponding to the plurality of selectable seating positions. The backrest can be positioned upright, at an angle, or flat with respect to the seating surface to provide a plurality of seating configurations including simultaneous forward and aft seats, an aft-facing lounge seat and a sunpad. The seating surface comprises hingeable seat cushions permitted access to storage compartments inside the base. The seating system can be installed adjacent to a bulkhead on a watercraft to provide an aft-facing lounge seat.

U.S. Pat. No. 9,260,166 discloses a seat for a marine vessel capable of multiple positions while maintaining a hidden or concealed look when closed. The seat has a seat back hingeably attached to a seat bottom and a seat back cap hingeably attached to a leading edge of the seat back. The seat is operable between a plurality of selected positions including an open position and a closed position. In the open position, the seat back is upright and the seat provides at least one traditional seating surface. In the closed position, the seat back rests substantially parallel on the seat bottom and a rear surface of the seat back functions as a sun pad. In the closed position, the seat back cap is deployed over a leading edge of the seat bottom and the leading edge of the seat back to conceal the seat. A positionable leg extension pad extends from the seat bottom.

U.S. Pat. No. 9,821,887 discloses a convertible seating system for a marine vessel includes a frame and a seat mounted on the frame and defining a first support surface. A backrest is configured for movement relative to the seat and the frame between a first position and a second position. In the second position, the backrest defines a second support surface lying generally parallel and vertically displaced relative to the first support surface.

U.S. Pat. No. 10,085,566 discloses a marine vessel that has a deck surface having a recessed cavity; a seat module having a seating member, an engagement member, and a hinge that couples the seating member to the engagement member; and a retainer configured to retain the engagement member with respect to the recessed cavity. The seating member is pivotable about the hinge into and between a closed position in which the seating member lies flush with the deck surface and covers the recessed cavity and an open position in which the seating member provides seating for user and the recessed cavity is exposed and provides leg room for the user.

U.S. Pat. No. 10,486,777 discloses a seating system that includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface. Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example of the present disclosure, a convertible seating system for a marine vessel that is movable between forward-facing seating, sunpad, and aft-facing seating configurations is provided. The system includes a stationary bracket coupled to a deck portion of the marine vessel, a forward-facing seat component and an aft-facing seat component. The forward-facing seat component includes a forward-facing base, a forward-facing cushion component, and a pair of inner pivot brackets. The aft-facing seat component includes an aft-facing base, an aft-facing cushion component, and a pair of outer pivot brackets. The inner and outer pivot brackets are pivotably coupled to the stationary bracket. The stationary bracket further includes a first plurality of locating holes and a second plurality of locating holes. A pair of inner spring pins extend through the pair of inner pivot brackets and into the first plurality of locating holes to lock the position of the forward-facing seat component. A pair of outer spring pins extend through the pair of outer pivot brackets and into the second plurality of locating holes to lock the position of the aft-facing seat component.

According to another example of the present disclosure, a convertible seating system for a marine vessel is provided. The system includes a stationary bracket coupled to a deck portion of the marine vessel, a forward-facing seat component that is pivotably coupled to the stationary bracket, and an aft-facing seat component that is pivotably coupled to the stationary bracket. The forward-facing seat component and the aft-facing seat component are configured to pivot relative to the stationary bracket between a forward-facing configuration in which a seating surface of the aft-facing seat component is substantially parallel to a horizontal plane and a seating surface of the forward-facing seat component is not substantially parallel to the horizontal plane, a sunpad configuration in which the seating surface of aft-facing seat component and the seating surface of the forward-facing seat component are substantially parallel to the horizontal plane, and an aft-facing configuration in which the seating surface of the forward-facing seat component is substantially parallel to the horizontal plane and the seating surface of the aft-facing seat component is not substantially parallel to the horizontal plane.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

Figure 1:
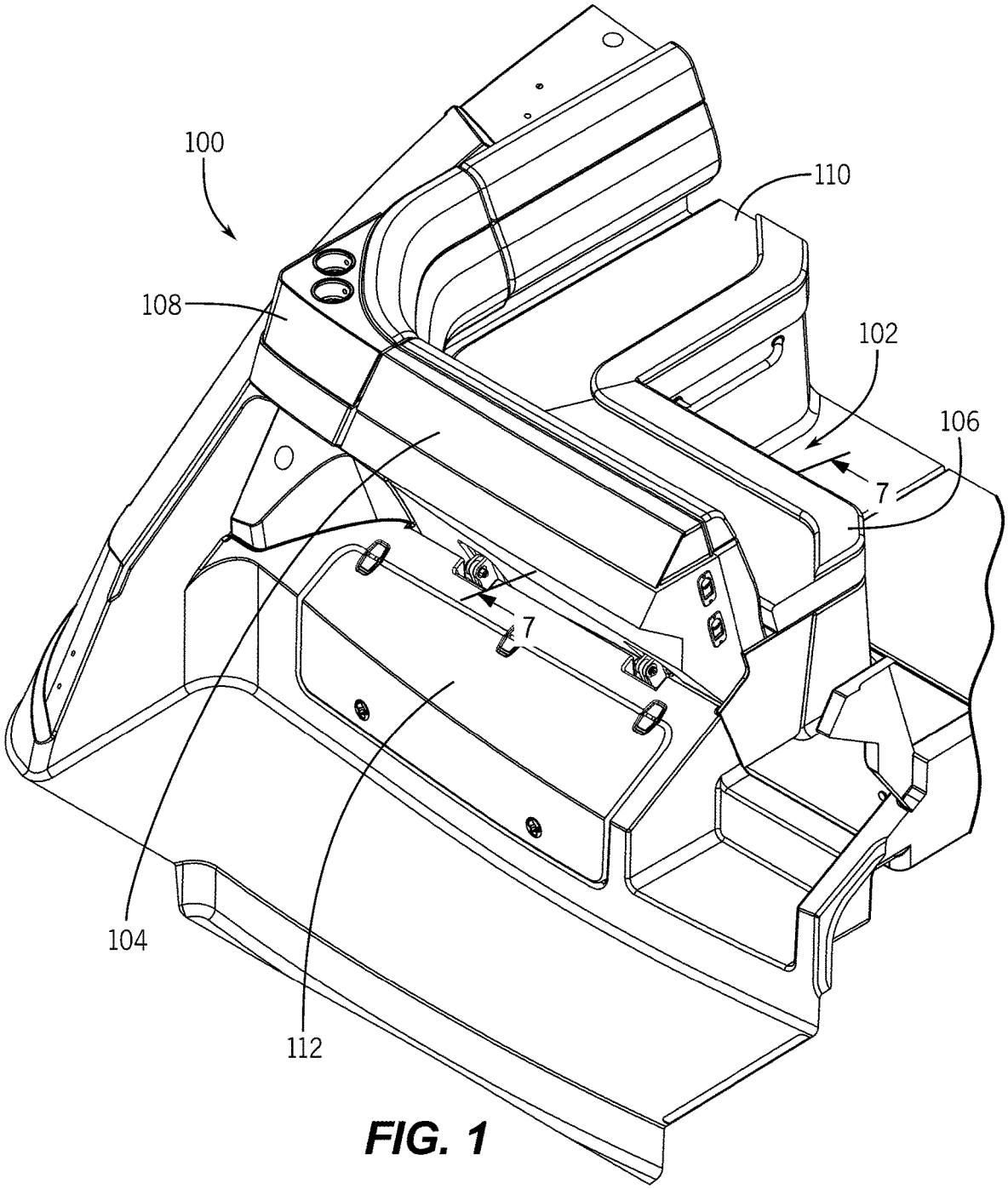
FIG. 1 is a perspective view of a boat provided with a convertible seating system in accordance with the present disclosure and showing a forward-facing configuration.
Figure 2:
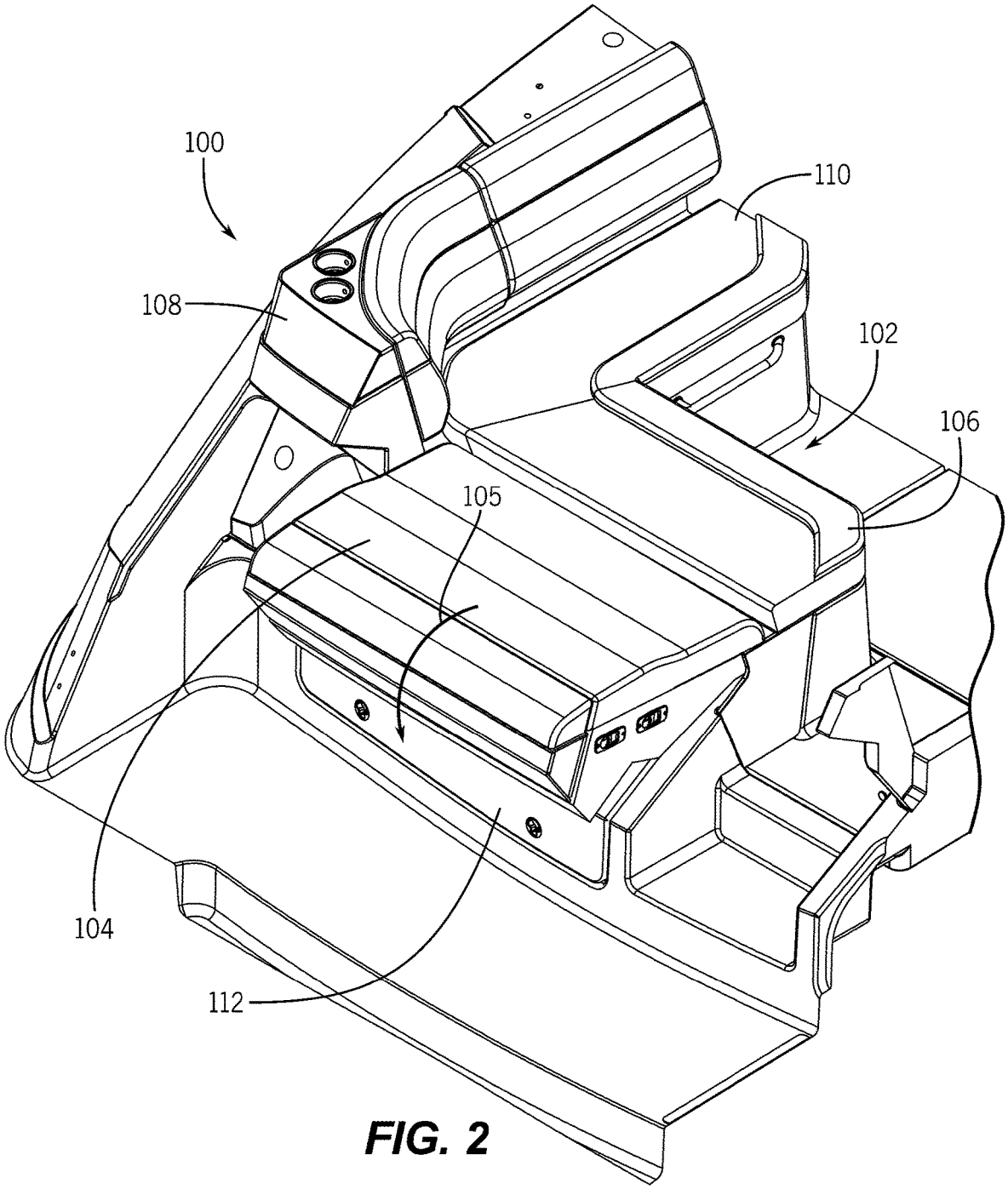
FIG. 2 is a perspective view of the convertible seating system of FIG. 1 in the sunpad configuration.
Figure 3:
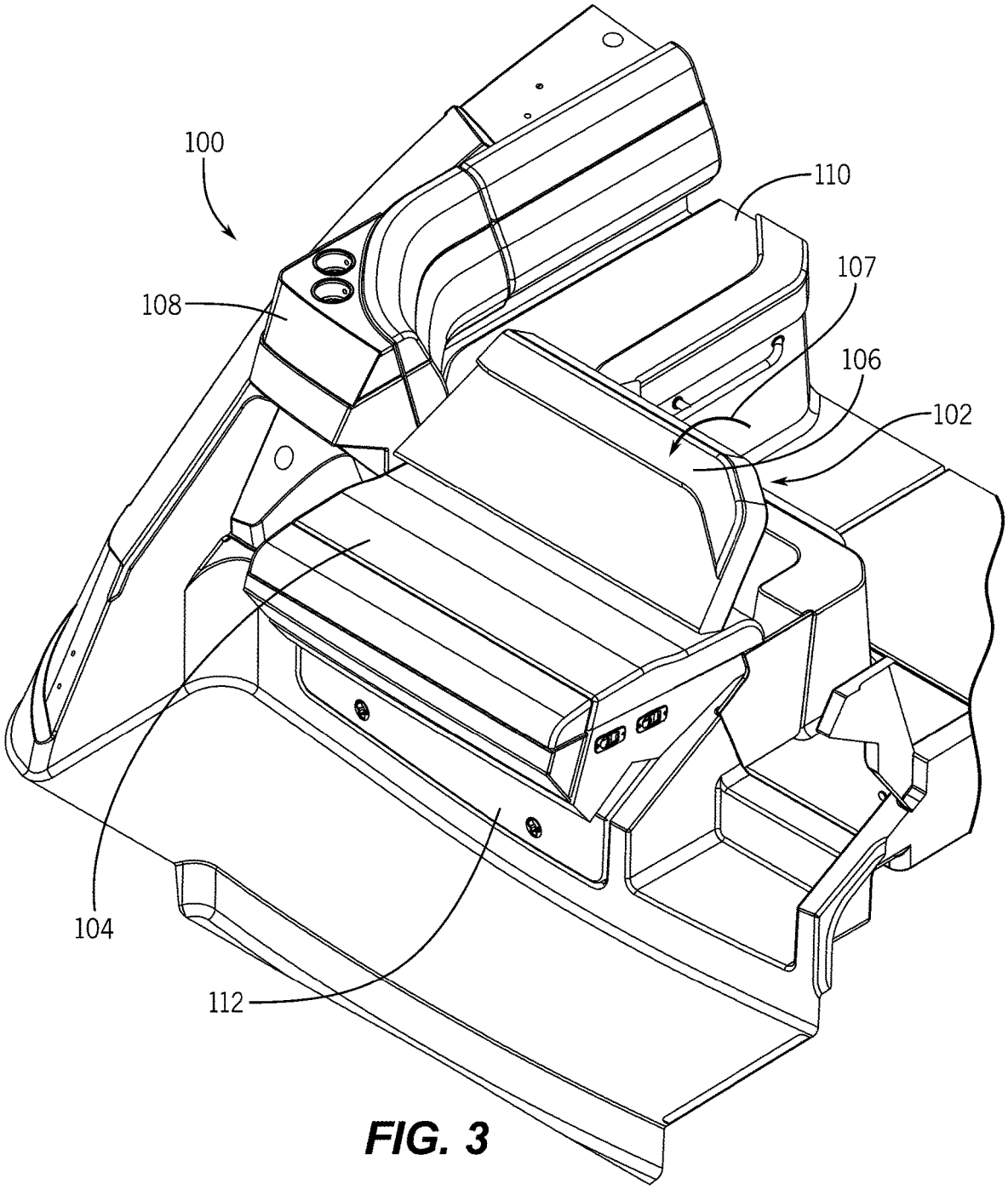
FIG. 3 is a perspective view of the convertible seating system of FIG. 1 in the aft-facing configuration.
Figure 4:
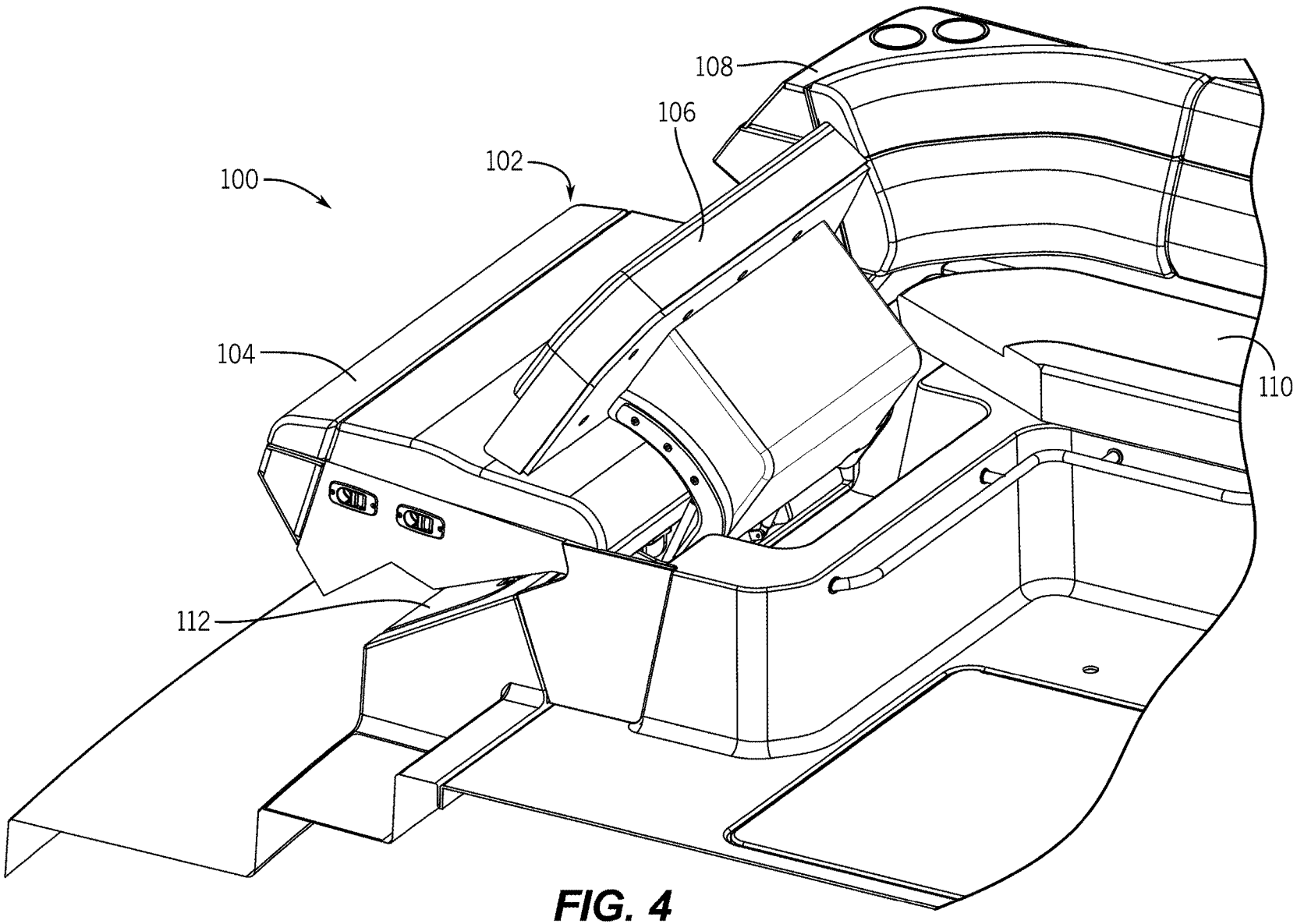
FIG. 4 is another perspective view of the convertible seating system of FIG. 1 in the aft-facing configuration.

FIGS. 1-4 illustrate a marine vessel 100 having a convertible seating system 102 in accordance with an exemplary preferred embodiment of the present disclosure. Specifically, FIG. 1 depicts a perspective view of the convertible seating system 102 in a forward-facing configuration, FIG. 2 depicts a perspective view of the system 102 in the sunpad configuration, and FIGS. 3 and 4 depict perspective views of the system 102 in the aft-facing configuration.

The convertible seating system 102 includes a forward-facing seat component 104 and an aft-facing seat component 106. As shown in FIG. 1, in the forward-facing configuration, the forward-facing seat component 104 functions as a backrest that is generally continuous with a stationary backrest portion 108 of the marine vessel 100, and the aft-facing seat component 106 functions as a seat that is generally continuous with a stationary seat portion 110 of the marine vessel 100 such that a person sitting on the convertible seating system 102 would face the bow of the marine vessel 100. A storage chest 112 is shown to be positioned and accessible below the forward-facing seat component 104. As shown in FIG. 2, in the sunpad configuration, the forward-facing seat component 104 is pivoted downwardly from a generally vertical position to a generally horizontal position as indicated by arrow 105 over the storage chest 112 to form a substantially flat horizontal surface with the aft-facing seat component 106. As shown in FIGS. 3 and 4, in the aft-facing configuration, the aft-facing seat component 106 is pivoted upwardly in the same direction as arrow 105 from a generally horizontal position to a semi-vertical position as indicated by arrow 107 to function as a backrest, while the forward-facing seat component 104 functions as a seat and a person sitting on the convertible seating system 102 would face the bow of the marine vessel 100.

Advantageously, the pivoting mechanisms of the convertible seating system 102 (described in further detail below with reference to FIGS. 5-9) are largely housed within interior regions of the forward-facing seat component 104 and the aft-facing seat component 106 such that the convertible seating system 102 has an attractive and continuous appearance with the stationary seating portions 108, 110 of the marine vessel 100. In addition, because the components of the pivoting mechanisms are largely inaccessible to the user, the safety risk to the user (e.g., due to pinched appendages, etc.) is significantly reduced.

Figure 5:
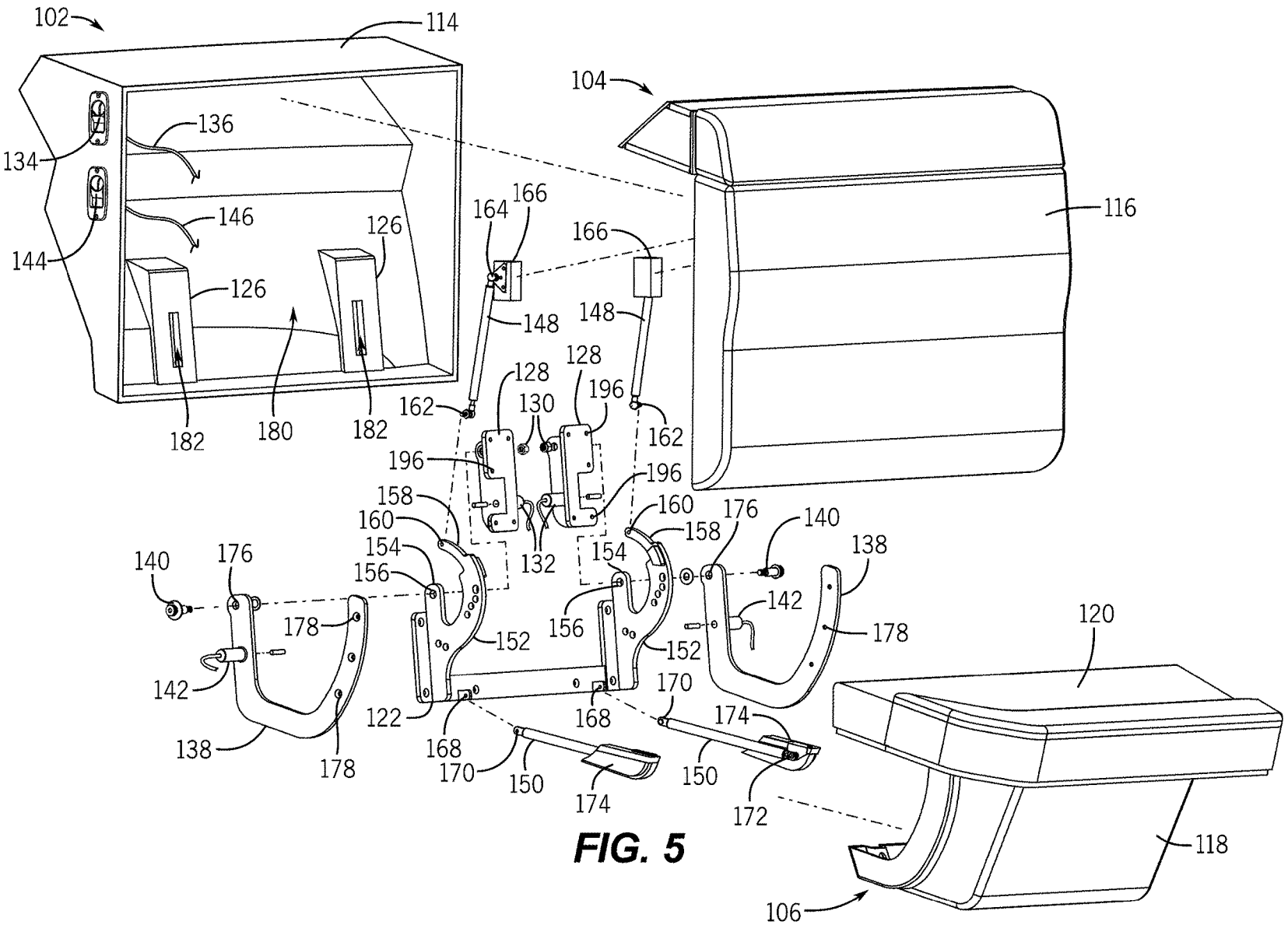
FIG. 5 is an exploded view of the convertible seating system of FIG. 1.
Figure 6:
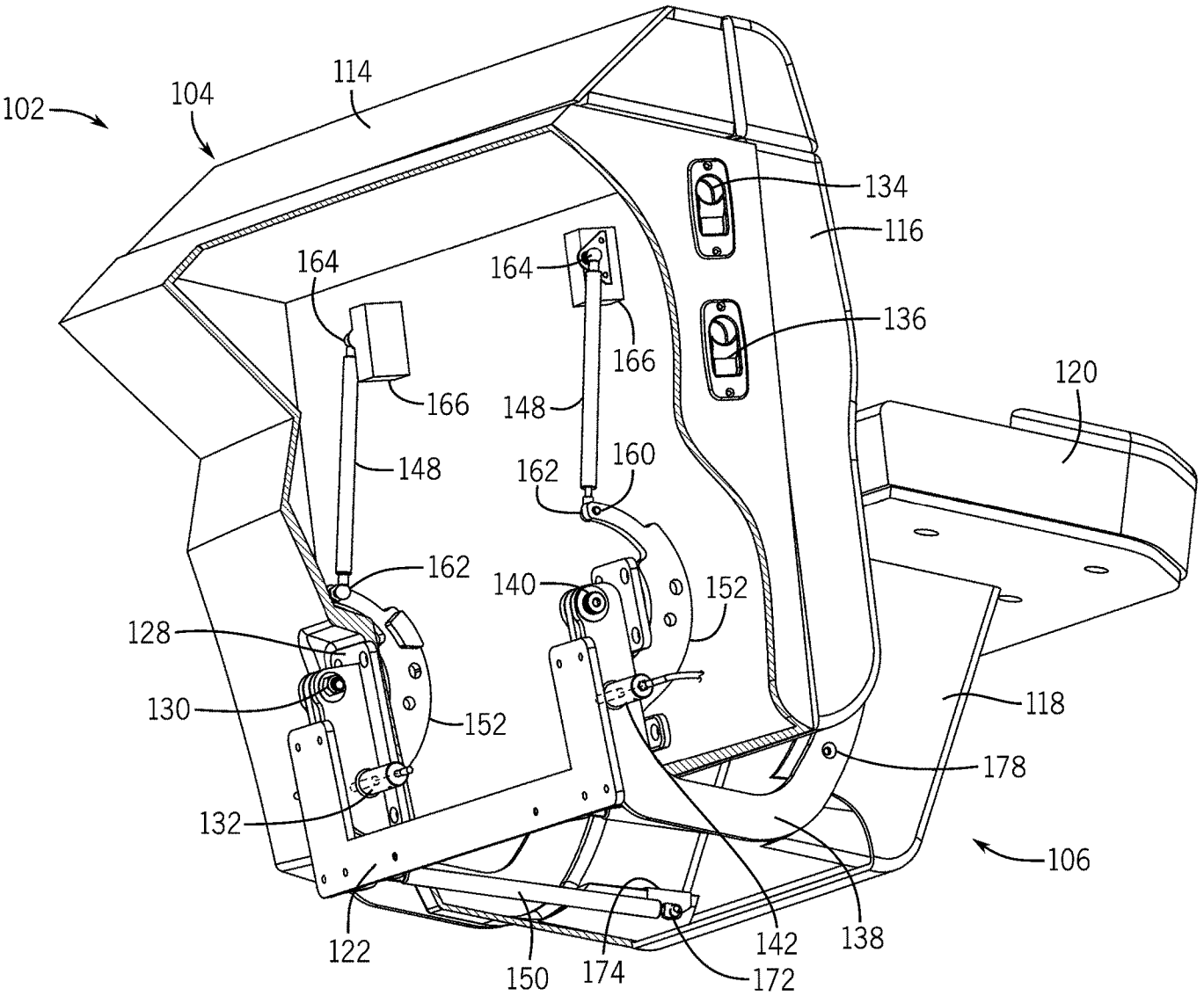
FIG. 6 is a partial section view of convertible seating system of FIG. 1 in the forward-facing configuration.
Figure 7:
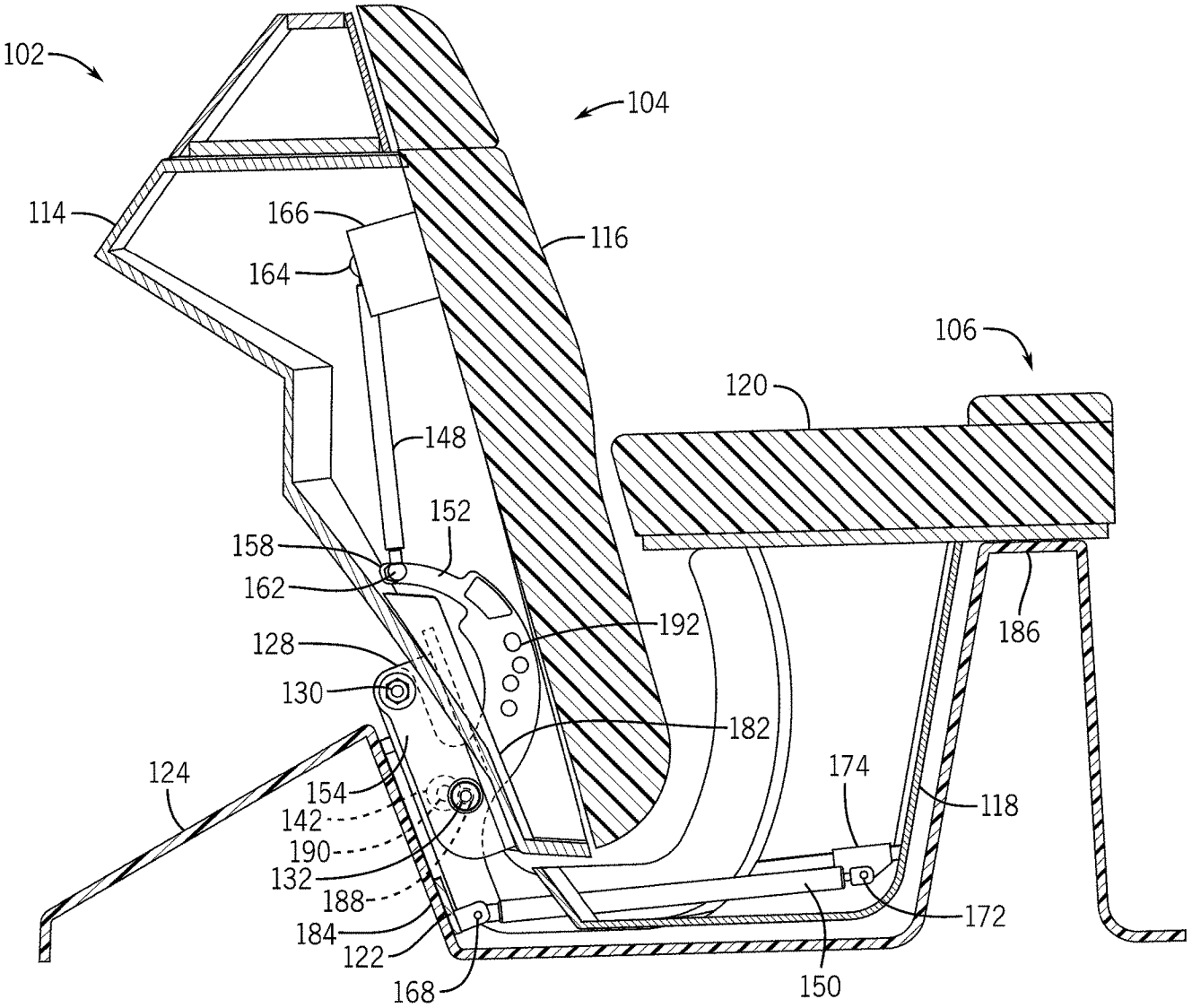
FIG. 7 is a side cross-sectional view of the convertible seating system of FIG. 1 in the forward-facing configuration.
Figure 8:
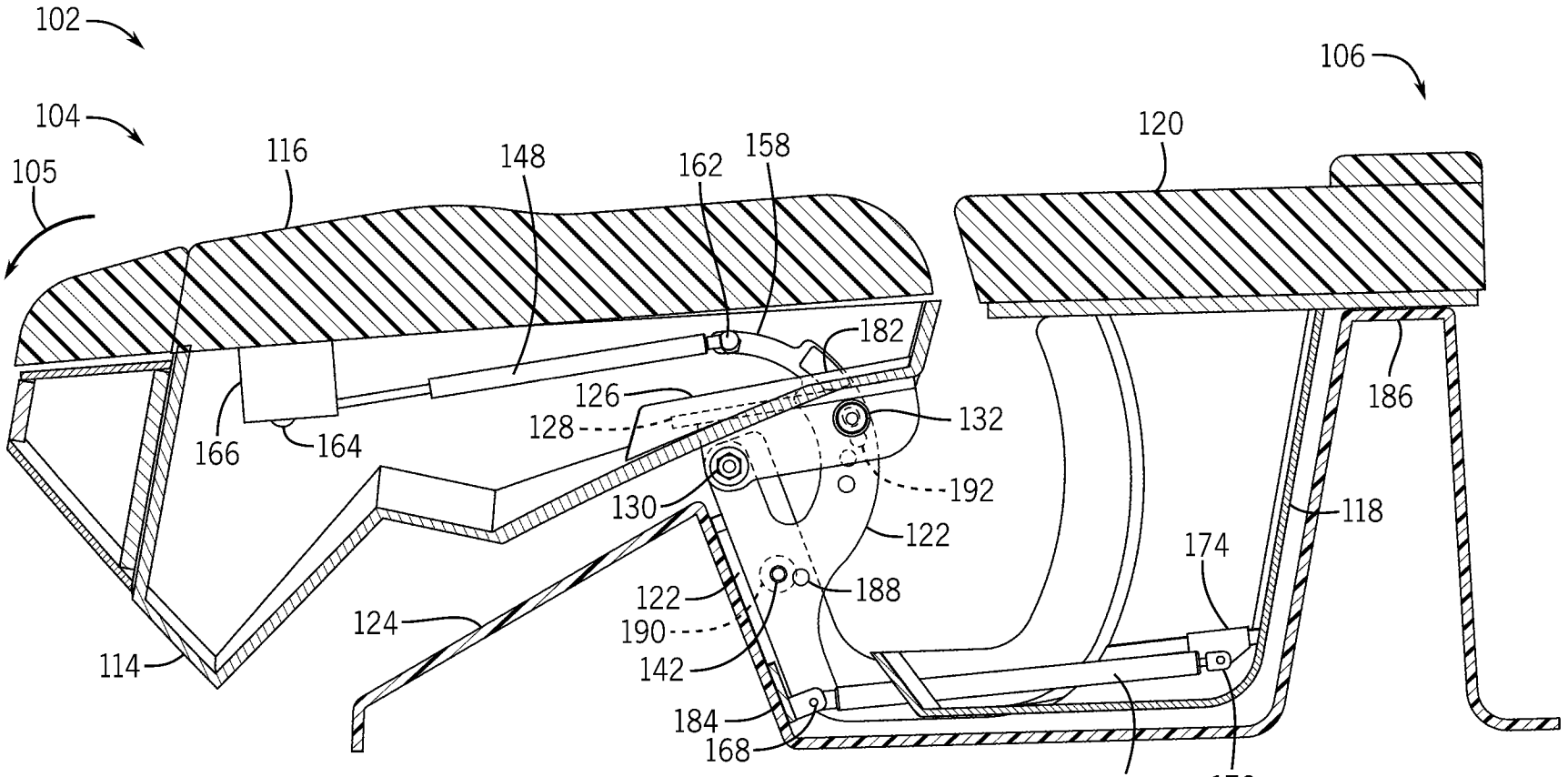
FIG. 8 is a side cross-sectional view of the convertible seating system of FIG. 1 in the sunpad configuration.
Figure 9:
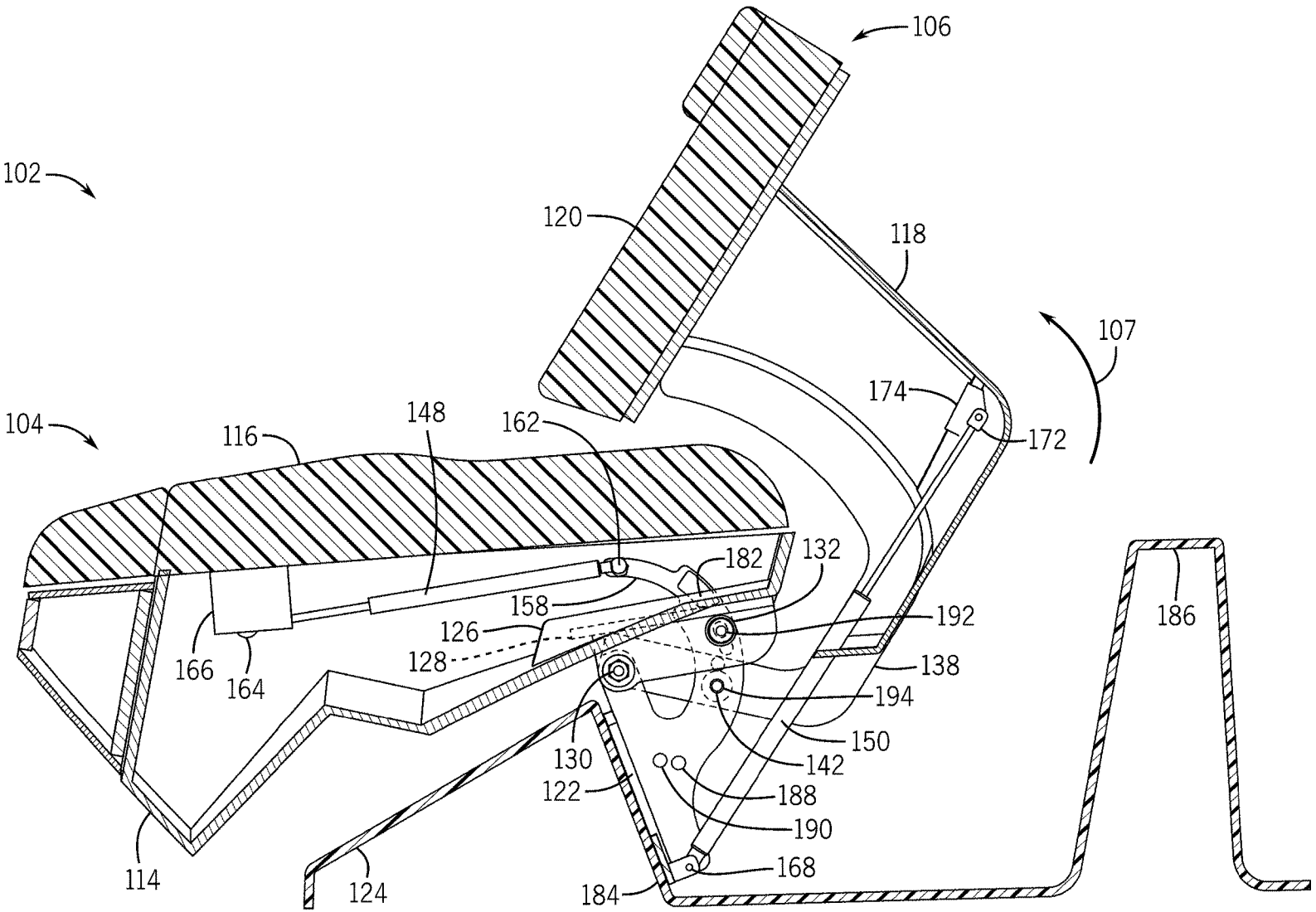
FIG. 9 is a side cross-sectional view of the convertible seating system of FIG. 1 in the aft-facing configuration.

FIGS. 5-9 depict the components of the pivoting mechanisms of the convertible seating system 102. Specifically, FIG. 5 depicts an exploded view of the system 102, FIG. 6 depicts a partial section view of the system 102 in the forward-facing configuration, FIG. 7 depicts a side cross-sectional view of the system 102 in the forward-facing configuration, FIG. 8 depicts a side cross-sectional view of the system 102 in the sunpad configuration, and FIG. 9 depicts a side cross-sectional view of the system 102 in the aft-facing configuration.

The forward-facing seat component 104 is shown to include a forward-facing base component 114 that is coupled to a forward-facing cushion component 116. The aft-facing seat component 106 is shown to include an aft-facing base component 118 that is coupled to an aft-facing cushion component 120.

The forward-facing seat component 104 and the aft-facing seat component 106 pivot between the various configurations relative to stationary bracket components 122 and 152. The stationary bracket component 122 is substantially U-shaped and coupled to an inclined portion 184 of a deck surface 124 (see FIGS. 7-9). The bracket components 152 are fixedly coupled and positioned orthogonally to the bracket component 122. Each bracket component 152 includes a first prong 154 and a second prong 158. The first prong 154 includes a pivot pin aperture 156 (to receive a pivot pin 130, described in further detail below). The second prong 158 includes a gas spring aperture 160 (to receive a first end 162 of a forward-facing component gas spring 148, also described in further detail below). When installed in the marine vessel 100, the stationary bracket component 122 and the first prongs 154 of the stationary bracket components 152 are both positioned between the inclined portion 184 of the deck surface 124 and the forward-facing base component 114 (see FIGS. 7-9). The second prongs 158 of the stationary bracket components 152 may reside within an interior region 180 (see FIG. 5) of the forward-facing base component 114 after being inserted through apertures 182 within bracket compartments 126 formed in the forward-facing base component 114.

The forward-facing seat component 104 is pivotably coupled to the stationary bracket components 122 and 152 using a pair of forward-facing inner pivot brackets 128. The inner pivot brackets 128 include multiple mounting holes 196 that may be utilized to secure the inner pivot brackets 128 to the bracket compartments 126 using any suitable fasteners. The pivot brackets 128 cause the forward-facing seat component 104 to pivot relative to the stationary bracket 122 using a pivot pin or fastener 140 that is secured by a nut 130. A pair of inner retractable spring pins 132 are shown to pass through the inner pivot brackets 128 and reside within one of a first series of locating holes formed in the stationary bracket components 152.

To rotate the forward-facing seat component 104 between different seating configurations relative to the stationary bracket components 122 and 152, a user may pull on a first handle 134 that is located in the forward-facing base component 114. A first cable 136 is attached at a first end to the first handle 134. Opposite the first end, the first cable 136 is attached to each of the inner retractable spring pins 132 such that pulling on the first handle 134 retracts the spring pins 132 from locating holes 188 in the stationary bracket components 152 (see FIG. 7). With the spring pins 132 retracted, the forward-facing seat component 104 can freely rotate as indicated by arrow 105 relative to the stationary bracket components 122 and 152 until the first handle 134 is released, causing the spring pins 132 to extend from their retracted positions and pass through the inner pivot brackets 128 into locating holes 192 in the stationary bracket components 152 (see FIGS. 7 and 8).

Similar to the forward-facing seat component 104, the aft-facing seat component 106 is pivotably coupled to the stationary bracket components 122 and 152 using a pair of aft-facing outer pivot brackets 138. Each aft-facing pivot bracket 138 is shown to be a generally U-shaped member. The pivot brackets 138 cause the aft-facing seat component 106 to pivot relative to the stationary bracket 122 using the pivot pin or fastener 140 that passes through a pivot hole 176 formed in each pivot bracket 138. Opposite the pivot hole 176, each pivot bracket 138 is shown to include multiple mounting holes 178 that are utilized to fasten the pivot brackets 138 to the aft-facing base component 118 (see FIG. 6).

As shown in FIGS. 7 and 8, when the convertible seating system 102 is in the forward-facing configuration or the sunpad configuration, a pair of outer retractable spring pins 142 are shown to pass through the outer pivot brackets 138 and reside within locating holes 190. To rotate the aft-facing seat component 106 between the different seating configurations relative to the stationary bracket components 122 and 152, a user may pull on a second handle 144 that is located in the forward-facing base component 114. A second cable 146 is attached at a first end to the second handle 144. Opposite the first end, the second cable 146 is attached to each of the outer spring pins 142 such that pulling on the second handle 144 retracts the spring pins 142 from the locating holes 190 in the stationary bracket component 152. With the spring pins 142 retracted, the aft-facing seat component 106 can freely rotate as indicated by the arrow 107 relative to the stationary bracket components 122 and 152 until the second handle 144 is released, causing the spring pins 142 to extend from their retracted positions and pass through the outer pivot brackets 138 into locating holes 194 within the stationary bracket components 152. In some implementations, additional locating holes may be formed in the stationary bracket components 152 to allow the forward-facing seat component 104 and the aft-facing seat component 106 to be secured at intermediate positions between the forward-facing, sunpad, and aft-facing configurations.

Control of the pivoting action of the forward-facing seat component 104 and the aft-facing seat component 106 may be aided through the use of gas springs. Still referring to FIGS. 5-9, the convertible seating system 102 is shown to include a pair of forward-facing component gas springs 148 and a pair of aft-facing component gas springs 150. Each of the gas springs 148, 150 includes a piston rod that extends from and retracts into a pressurized cylinder.

The forward-facing gas springs 148 may be pull-type gas springs in which the gas pressure in the cylinder pulls in the piston rod into a retracted position within the cylinder (as depicted in FIGS. 6 and 7, when the convertible seating system 102 is in the forward-facing configuration), and an external force provided by the user is required to extend the piston rod from the cylinder (as depicted in FIGS. 8 and 9, in which the convertible seating system 102 is in the sunpad and aft-facing configurations, respectively). Each of the forward-facing gas springs 148 is shown to include a piston rod that terminates in a first end 162 and a cylinder that terminates in a second end 164. Each first end 162 is fastened to the corresponding gas spring aperture 160 in the stationary bracket component 152. Each second end 164 is fastened to a mounting block 166 that is coupled to the forward-facing base component 114 (see FIG. 6).

The aft-facing gas springs 150 may be push-type gas springs in which the gas pressure in the cylinder pushes the piston rod into an extended position out of the cylinder (as depicted in FIG. 9, when the convertible seating system 102 is in the aft-facing configuration), and an external force provided by the user is required to retract the piston rod into the cylinder (as depicted in FIGS. 7 and 8, in which the convertible seating system 102 is in the forward-facing and sunpad configurations, respectively). Each of the aft-facing gas springs 150 is shown to include a piston rod that terminates in a first end 170 and a cylinder that terminates in a second end 172. Each first end 170 is fastened to a corresponding gas spring aperture 168 in the stationary bracket component 122. Each second end 172 is fastened to a mounting block 174 that is coupled to the aft-facing base component 118 (see FIG. 6).

In the present disclosure, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A convertible seating system for a marine vessel, comprising:

a stationary bracket coupled to a deck portion of the marine vessel and comprising a first plurality of locating holes and a second plurality of locating holes;

a forward-facing seat component comprising:

a forward-facing base;

a forward-facing cushion component; and a pair of inner pivot brackets, wherein the pair of inner pivot brackets are pivotably coupled to the stationary bracket;

an aft-facing seat component comprising:

an aft-facing base;

an aft-facing cushion component; and a pair of outer pivot brackets, wherein the pair of outer pivot brackets are pivotably coupled to the stationary bracket;

a pair of inner spring pins that extend through the pair of inner pivot brackets and into the first plurality of locating holes to lock a position of the forward-facing seat component relative to the stationary bracket; and a pair of outer spring pins that extend through the pair of outer pivot brackets and into the second plurality of locating holes to lock a position of the aft-facing seat component relative to the stationary bracket.

2. The convertible seating system of claim 1, wherein the forward-facing seating component and the aft-facing seating component are pivotable relative to the stationary bracket between a forward-facing seating configuration, a sunpad configuration, and an aft-facing seating configuration.

3. The convertible seating system of claim 2, wherein a seating surface of the aft-facing cushion component is substantially parallel to a horizontal plane in the forward-facing seating configuration and the sunpad configuration.

4. The convertible seating system of claim 3, wherein a seating surface of the forward-facing cushion component is substantially parallel to the horizontal plane in the sunpad configuration and the aft-facing seating configuration.

5. The convertible seating system of claim 1, further comprising a pair of forward-facing component gas springs, each of the forward-facing component gas springs comprising a first end that is coupled to the stationary bracket and a second end that is coupled to the forward-facing base.

6. The convertible seating system of claim 5, wherein each of the forward-facing component gas springs further comprises a cylinder and a piston rod, and wherein each of the forward-facing component gas springs is a pull-type gas spring in which gas pressure in the cylinder pulls the piston rod into a retracted position within the cylinder.

7. The convertible seating system of claim 1, further comprising a pair of aft-facing component gas springs, each of the aft-facing component gas springs comprising a first end that is coupled to the stationary bracket and a second end that is coupled to the aft-facing base.

8. The convertible seating system of claim 7, wherein each of the aft-facing component gas springs further comprises a cylinder and a piston rod, and wherein each of the aft-facing component gas springs is a push-type gas spring in which gas pressure in the cylinder pushes the piston rod into an extended position out of the cylinder.

9. The convertible seating system of claim 1, further comprising a first handle and a first cable that is coupled to the first handle and the pair of inner spring pins, wherein a pull force on the first handle retracts the pair of inner spring pins from the first plurality of locating holes to permit the forward-facing seat component to pivot relative to the stationary bracket.

10. The convertible seating system of claim 9, further comprising a second handle and a second cable that is coupled to the second handle and the pair of outer spring pins, wherein a pull force on the second handle retracts the pair of outer spring pins from the second plurality of locating holes to permit the aft-facing seat component to pivot relative to the stationary bracket.

11. A convertible seating system for a marine vessel, comprising:

a stationary bracket coupled to a deck portion of the marine vessel;

a forward-facing seat component that is pivotably coupled to the stationary bracket and comprises a forward-facing base, a forward-facing cushion component, and a pair of inner pivot brackets;

an aft-facing seat component that is pivotably coupled to the stationary bracket; and a pair of forward-facing component gas springs, each of the forward-facing component gas springs comprising a first end that is coupled to the stationary bracket and a second end that is coupled to the forward-facing base;

wherein at least a portion of the stationary bracket is located within an interior region of the forward-facing seat component defined by the forward-facing base and the forward-facing cushion component; and wherein the forward-facing seat component and the aft-facing seat component are configured to pivot relative to the stationary bracket between:

a forward-facing configuration in which a seating surface of the aft-facing seat component is substantially parallel to a horizontal plane and a seating surface of the forward-facing seat component is not substantially parallel to the horizontal plane;

a sunpad configuration in which the seating surface of aft-facing seat component and the seating surface of the forward-facing seat component are substantially parallel to the horizontal plane; and an aft-facing configuration in which the seating surface of the forward-facing seat component is substantially parallel to the horizontal plane and the seating surface of the aft-facing seat component is not substantially parallel to the horizontal plane.

12. The convertible seating system of claim 11, further comprising a pair of inner spring pins that extend through the pair of inner pivot brackets and into a first plurality of locating holes in the stationary bracket to lock a position of the forward-facing seat component relative to the stationary bracket.

13. The convertible seating system of claim 12, further comprising a first handle and a first cable that is coupled to the first handle and the pair of inner spring pins, wherein a pull force on the first handle retracts the pair of inner spring pins from the first plurality of locating holes to permit the forward-facing seat component to pivot relative to the stationary bracket.

14. The convertible seating system of claim 13, wherein the aft-facing seat component comprises an aft-facing base, an aft-facing cushion component, and a pair of outer pivot brackets.

15. The convertible seating system of claim 14, further comprising a pair of aft-facing component gas springs, each of the aft-facing component gas springs comprising a first end that is coupled to the stationary bracket and a second end that is coupled to the aft-facing base.

16. The convertible seating system of claim 14, further comprising a pair of outer spring pins that extend through the pair of outer pivot brackets and into a second plurality of holes in the stationary bracket to lock a position of the aft-facing seat component relative to the stationary bracket.

17. The convertible seating system of claim 16, further comprising a second handle and second cable that is coupled to the second handle and the pair of outer spring pins, wherein a pull force on the second handle retracts the pair of outer spring pins from the second plurality of locating holes to permit the aft-facing seat component to pivot relative to the stationary bracket.

18. The convertible seating system of claim 17, wherein the first handle and the second handle are coupled to the forward-facing base.

* * * * *